US005260756A

United States Patent [19]

Yanai et al.

[11] Patent Number: 5,260,756

[45] Date of Patent: Nov. 9, 1993

[54] CLEANING BLADE FOR ELECTROPHOTOGRAPHY

[75] Inventors: Noriyuki Yanai; Masahiro Watabe, both of Yokohama, Japan

[73] Assignee: Canon Kabushiki Kaisha, Tokyo, Japan

[21] Appl. No.: 571,130

[22] Filed: Aug. 23, 1990

[30] Foreign Application Priority Data

Aug. 25, 1989 [JP] Japan ..... 1-219771

[51] Int. Cl.[5] ..... G03G 21/00

[52] U.S. Cl. ..... 355/299; 15/256.51; 358/300

[58] Field of Search ..... 355/210, 200, 270, 296, 355/299; 15/256.51; 428/423.1, 323; 358/300; 525/132, 66, 404, 424

[56] References Cited

U.S. PATENT DOCUMENTS 3,973,845 8/1976 Lindblad et al. .
4,487,888 12/1984 Coran et al. ..... 525/132
4,823,161 4/1989 Yamada et al. ..... 355/299
4,937,633 6/1990 Ewing ..... 355/299
4,959,731 9/1990 Fukae ..... 358/300
4,965,633 10/1990 Surti ..... 355/200

FOREIGN PATENT DOCUMENTS 54-71646 8/1979 Japan .
55-77774 6/1980 Japan .
62-11719 1/1987 Japan .

OTHER PUBLICATIONS

Paul R. Spencer, et al., *Impregnated Poromeric Material Cleaning Blade,* Xerox Disclosure Journal, vol. 1, No. 4, Apr., 1976.

*Primary Examiner*—A. T. Grimley
*Assistant Examiner*—Shuk Y. Lee
*Attorney, Agent, or Firm*—Fitzpatrick, Cella, Harper & Scinto

[57] ABSTRACT

A cleaning blade for electrophotography, including an urethane elastomeric material incorporated with a porous nylon powder in such a manner that particles of the powder are embedded into the urethane elastomeric material.

7 Claims, 1 Drawing Sheet

CLEANING BLADE FOR ELECTROPHOTOGRAPHY

BACKGROUND OF THE INVENTION

1. Field of the Invention

The present invention relates to a cleaning blade used in electrophotography, which slidingly rubs the surface of a photosensitive member to clean it, and also relates to an apparatus making use of the cleaning blade.

2. Related Background Art

The cleaning blade for electrophotography is a plate-like molded product mainly comprising a polyurethane elastomeric material. The cleaning blade is used for the purpose of physically cleaning and removing the toner adhered to the surface of the photosensitive member, by bringing the blade into contact with the surface. In such an instance, however, the blade must resist the electrostatic attraction force of toner particles, exerted on the surface of the photosensitive member, before it can remove the toner particles from the surface of the photosensitive member. Hence, it must be pressed against the surface of the photosensitive member with great pressure. Thus, great frictional force is produced between the photosensitive member and the cleaning blade, and therefore it may occur that the cleaning blade is turned and reversed, resulting in no cleaning operation, or that the surface is scraped when the photosensitive member is made of a soft material, bringing abcut defective images or a short life of the photosensitive member.

To solve such problems, measures have been hitherto taken such that a lubricant is applied to the top of a blade or a powder of fluorine resin, such as PTFE, is incorporated into it. However, the method in which a lubricant is applied to the top of the blade can be effective only for a short period of time. The method in which a fluorine resin powder is incorporated into the top of the blade has the disadvantages such that the fluorine resin falls off in the course of cleaning because of an insufficiency of the retention power of rubber to the fluorine resin, resulting in a lowering of the cleaning performance.

SUMMARY OF THE INVENTION

Accordingly, an object of the present invention is to provide a cleaning blade capable of remarkably decreasing the frictional force between the cleaning blade and the photosensitive member, thereby preventing the turn-over of the blade, reducing the scraping of the surface of the photosensitive member, and also preventing falling-off of particle components over a long period of time to obtain a good image.

The present invention provides a cleaning blade for electrophotography, comprising a blade of a urethane elastomeric material, wherein at least part thereof that comes into contact with the surface of a photosensitive member is incorporated with a porous nylon powder in such a manner that particles of the powder are embedded into the urethane elastomeric material.

The cleaning blade for electrophotography according to the present invention makes it possible to remarkably decrease the coefficient of friction to prevent the turn-over of the cleaning blade that has been hitherto questioned, and thus makes it possible to maintain superior cleaning effect over a long period of time.

DESCRIPTION OF THE PREFERRED EMBODIMENTS

The porous nylon powder used in the present invention includes, for example, SNP-609W, SNP-613, SNP-619 and SNP-6643 (products of Metal Color Co.), but is by no means limited to these products. In a polyurethane rubber (i.e., the urethane elastomeric material) at the part that comes into contact with the surface of a photosensitive member, the porous nylon powder may preferably be contained in an amount ranging from 1 to 70 wt. %. The porous nylon powder may preferably have an average particle diameter of not more than 20 microns in view of dispersibility and molding properties. Since the nylon powder is porous, it can be firmly joined to the urethane rubber.

The "porous nylon powder" herein used refers to nylon particles having a large number of voids in the structure and having a bulk density of not more than 0.5 g/ml. The bulk density can be determined according to the measuring method as described in JIS K 6220.

Known urethane rubber materials can be used as the polyurethane rubber material used in the present invention. Particularly preferred in view of a small permanent set is a two-pack thermosetting polyurethane rubber material. Particularly in the cleaning blade of the present invention, which is molded using the urethane rubber material containing the porous nylon powder only at the frictionally sliding part, it is preferred from the view point of adhesion that the urethane rubber material containing the porous nylon powder is comprised of a material similar to the material that constitutes the main body of the cleaning blade.

Figure 1:
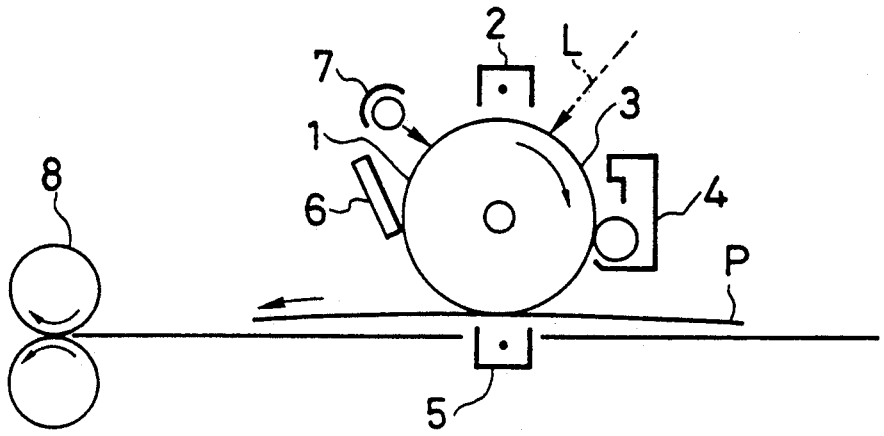
FIG. 1 illustrates a schematic construction of a commonly available electrophotographic apparatus in which the cleaning blade according to the present invention is employed.

FIG. 1 schematically illustrates the constitution of a commonly available transfer type electrophotographic apparatus in which a cleaning blade according to the present invention is used.

In FIG. 1, the numeral 1 denotes a drum photosensitive member serving as an image carrier which is rotated around a shaft 1*a* at a given peripheral speed in the direction shown by arrow. In the course of rotation, the photosensitive member 1 is uniformly charged on its periphery, with a positive or negative given potential by the operation of a charging means 2, and then photoimagewise exposed to light L (slit exposure, laser beam scanning exposure, etc.) at an exposure area 3 by the operation of an image exposure means (not shown). As a result, electrostatic latent images corresponding to the exposure images are successively formed on the periphery of the photosensitive member.

The electrostatic latent images thus formed are subsequently developed by a toner by the operation of a developing means 4. The resulting toner-developed images are then successively transferred by the operation of a transfer means 5, to the surface of a transfer medium P fed from a paper feed section (not shown) to the part between the photosensitive member 1 and the transfer means 5 in the manner synchronized with the rotation of the photosensitive member 1.

The transfer medium P on which the images have been transferred is separated from the surface of the photosensitive member and led through an image-fixing means 8, where the images are fixed and then delivered to the outside as a transcript (a copy).

The charging of the photosensitive member 1 after the transfer of images is ready for removal of the toner remaining after the transfer, using a cleaning blade 6. Thus the photosensitive member is cleaned on its surface, and further it is subjected to removal of charges by the operation of a pre-exposure means 7 and then repeatedly used for the formation of images.

The charging means 2 for giving uniform charge on the photosensitive member 1 include corona chargers, which are commonly put into wide use. As the transfer means 5, corona transfer units are also commonly put into wide use.

The electrophotographic apparatus may be constituted of a combination of plural components joined as one apparatus unit from among the constituents such as the above photosensitive member, developing means and cleaning blade so that the unit can be freely mounted on or detached from the body of the apparatus. For example, at least one of the charging means and the developing means may be held into one unit together with the cleaning blade and the photosensitive member so that the unit can be freely mounted or detached using a guide means such as a rail provided in the body of the apparatus. Here, the above apparatus unit may be so constituted as to be joined together with the charge means and/or the developing means.

In the case when the electrophotographic apparatus is used as a copying machine or a printer, an optical image exposure L is carried out by use of light reflected from, or transmitted through, an original, or the original is read out and the optical information is converted to a signal, according to which signal the scanning of a laser beam, driving of a light-emitting diode array, or driving of a liquid crystal shutter array is performed to carry out the optical image exposure.

Figure 2:
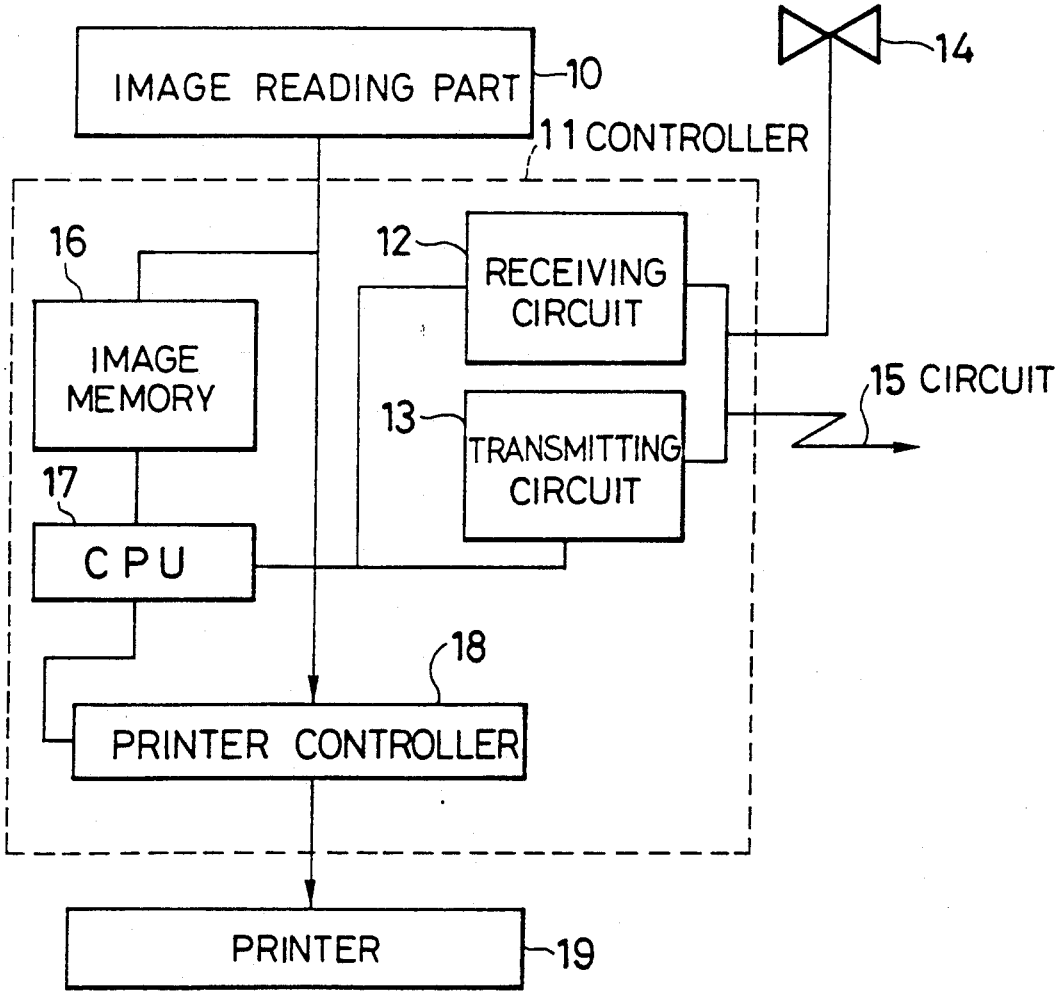
FIG. 2 is a block diagram of a facsimile system in which an electrophotographic apparatus employing the cleaning blade of the present invention is used as a printer.

When used as a printer of a facsimile system, the optical image exposing light L serves as exposing light used for the printing of received data. FIG. 2 illustrates an example thereof in the form of a block diagram.

In FIG. 2, a controller 11 controls an image reading part 10 and a printer 19. The whole of the controller 11 is controlled by CPU 17. Data outputted from the image reading part is sent to the other facsimile station through a transmitting circuit 13. Data received from the other station is sent to a printer 19 through a receiving circuit 12. Given image data are stored in an image memory 16. A printer controller 18 controls the printer 19. The numeral 14 denotes a telephone.

An image received from a circuit 15 (image information from a remote terminal connected through the circuit) is demodulated in the receiving circuit 12, and then successively stored in an image memory 16 after the image information is decoded by the CPU 17. Then, when images for at least one page have been stored in the memory 16, the image recording for that page is carried out. The CPU 17 reads out the image information for one page from the memory 16 and sends the coded image information for one page to the printer controller 18. The printer controller 18, having received the image information for one page from the CPU 17, controls the printer 19 so that the image information for one page is recorded.

The CPU 17 receives image information for the next page in the course of the recording by the printer.

Images are received and recorded in the above way.

The present invention will be described below in greater detail by giving Examples. In the following, "part(s)" is by weight.

EXAMPLE 1

| | |
|---|---|
| Polyurethane material: | |
| Ethylene adipate type urethane prepolymer (Mn1500, a product of Nippon Polyurethane Industry Co., Ltd.; NCO content: 6.2 wt. %) | 100 parts |
| Porous nylon: | |
| SNP-609 (a product of Metal Color Co.; average particle diameter: 9 μm) | 20 parts |
| Curing agents: | |
| 1,4-butanediol | 3.9 parts |
| Trimethylolpropane | 2.1 parts |

In the polyurethane material melted by heating, the porous nylon from which water content was removed by drying under reduced pressure was dispersed. A urethane prepolymer containing the porous nylon was thus prepared. Next, the curing agents, 1,4-butanediol and trimethylolpropane, were mixed into the prepolymer, and the mixture was cast into a mold previously fitted with a sheet metal, followed by heat curing. The cured product was cut into the desired size to prepare a cleaning blade made of a urethane containing porous nylon.

EXAMPLE 2

| | |
|---|---|
| Polyurethane material: | |
| Ethylene adipate type urethane prepolymer (Mn1500, a product of Nippon Polyurethane Industry Co., Ltd.; NCO content: 6.2 wt. %) | 100 parts |
| Porous nylon: | |
| SNP-613 (a product of Metal Color Co.; average particle diameter: 13 μm) | 20 parts |
| Curing agents: | |
| 1,4-butanediol | 3.7 parts |
| Trimethylolpropane | 2.0 parts |

In the polyurethane material melted by heating, the porous nylon from which water content was removed by drying under reduced pressure was dispersed. A urethane prepolymer containing the porous nylon was thus prepared. Next, the curing agents, 1,4-butanediol and trimethylolpropane, were mixed into the prepolymer, and the mixture was cast into a mold previously fitted with a sheet metal, followed by heat curing. The cured product was cut into the desired size to prepare a cleaning blade made of a urethane containing porous nylon.

EXAMPLE 3

| | |
|---|---|
| Polyurethane material: | |
| Ethylene adipate type urethane prepolymer (Mn1500, a product of Nippon Polyurethane Industry Co., Ltd.; NCO content: 6.2 wt. %) | 100 parts |
| Porous nylon: | |
| SNP-613 (a product of Metal Color Co.; average | 50 parts |

-continued

| | |
|---|---|
| particle diameter: 13 μm) | |
| Curing agents: | |
| 1,4-butanediol | 3.5 parts |
| Trimethylolpropane | 1.9 parts |

In the polyurethane material melted by heating, the porous nylon from which water content was removed by drying under reduced pressure was dispersed. A urethane prepolymer containing the porous nylon was thus prepared. Next, the curing agents, 1,4-butanediol and trimethylolpropane, were mixed into the prepolymer, and the mixture was cast into a mold previously fitted with a sheet metal, followed by heat curing. The cured product was cut into the desired size to prepare a cleaning blade made of a urethane containing porous nylon.

EXAMPLE 4

| | |
|---|---|
| Polyurethane material: | |
| Ethylene adipate type urethane prepolymer (Mn1500, a product of Nippon Polyurethane Industry Co., Ltd.; NCO content: 6.2 wt. %) | 100 parts |
| Porous nylon: | |
| SNP-619 (a product of Metal Color Co.; average particle diameter: 19 μm) | 30 parts |
| Curing agents: | |
| 1.4-butanediol | 3.7 parts |
| Trimethylolpropane | 2.0 parts |

In the polyurethane material melted by heating, the porous nylon from which water content was removed by drying under reduced pressure was dispersed. A urethane prepolymer containing the porous nylon was thus prepared. Next, the curing agents, 1,4-butanediol and trimethylolpropane, were mixed into the prepolymer, and the mixture was cast into a mold previously fitted with a sheet metal, followed by heat curing. The cured product was cut into the desired size to prepare a cleaning blade made of a urethane containing porous nylon.

COMPARATIVE EXAMPLE 1

| | |
|---|---|
| Polyurethane material: | |
| Ethylene adipate type urethane prepolymer (Mn1500, a product of Nippon Polyurethane Industry Co., Ltd.; NCO content: 6.2 wt. %) | 100 parts |
| Curing agents: | |
| 1,4-butanediol | 3.9 parts |
| Trimethylolpropane | 2.1 parts |

In the polyurethane material melted by heating, the curing agents, 1,4-butanediol and trimethylolpropane, were mixed, and the mixture was cast into a mold, followed by heat curing. The cured product was cut into the desired size to prepare a cleaning blade.

COMPARATIVE EXAMPLE 2

| | |
|---|---|
| Polyurethane material: | |
| Ethylene adipate type urethane prepolymer (Mn1500, a product of Nippon Polyurethane Industry Co., Ltd.; NCO content: 6.2 wt. %) | 100 parts |
| Fluorine resin powder: | |
| Lubron L-2 | 20 parts |

-continued

| | |
|---|---|
| (a product of Daikin Industries, Ltd.; average particle diameter: 5 μm) | |
| Curing agents: | |
| 1,4-butanediol | 3.9 parts |
| Trimethylolpropane | 2.1 parts |

In the polyurethane material melted by heating, the fluorine resin powder was dispersed. A urethane prepolymer containing fluorine resin was thus prepared. Next, the curing agents, 1,4-butanediol and trimethylolpropane, were mixed into the prepolymer, and the mixture was cast into a mold previously fitted with a blade made of urethane, followed by heat curing. The cured product was cut into the desired size to prepare a cleaning blade having a urethane tip containing fluorine resin.

The cleaning blades molded in the manners described above were tested to evaluate their coefficients of friction, and the initial-stage turnover and cleaning performance on an electrophotographic copying machine (Color Laser Copier, manufactured by Canon Inc.; Copier is a trademark). Results obtained are shown in Table 1.

TABLE 1

| | Example | | | | Comparative Example | |
|---|---|---|---|---|---|---|
| | 1 | 2 | 3 | 4 | 1 | 2 |
| Coefficient of friction: | 1.5 | 1.2 | 0.8 | 1.2 | 5.0 | 0.9 |
| Initial-stage turn-over*: | A | A | A | A | B | A |
| Cleaning performance**: | A | A | A | A | B | C |

*In the initial-stage turn-over, "A" indicates that no turn-over occurred; and "B", the blade turned over, resulting in no drive of the photosensitive member.
**In the cleaning performance, "A" indicates that no faulty copy occurred on 5,000 sheet copying; "B", an edge stain occurred on 3,000 sheet copying; and "C", lines appeared on 1,000 sheet copying because of fall-off of the fluorine resin.

What is claimed is:

1. A cleaning blade for electrophotography, comprising a urethane elastomeric material incorporated with a porous nylon powder in such a manner that particles of the powder are embedded into the urethane elastomeric material to provide a substantially non-porous contact surface portion.

2. A cleaning blade according to claim 1, wherein said porous nylon powder is contained in an amount of from 1% to 70% by weight in the urethane elastomeric material where it comes into contact with a surface of a photosensitive member.

3. A cleaning blade according to claim 1, wherein said porous nylon powder has an average particle diameter of not more than 20 μm.

4. A cleaning blade according to claim 1, wherein said porous nylon powder has a bulk density of not more than 0.5 g/ml.

5. Apparatus, comprising a unit in which at least one of a charging means and a developing means is held together as one unit with a cleaning blade, comprising a urethane elastomeric material incorporated with a porous nylon powder in such a manner that particles of the powder are embedded into the urethane elastomeric material to provide a substantially non-porous contact surface portion, and a photosensitive member so that the unit can be freely mounted on or detached from a main body of the apparatus.

6. An electrophotographic apparatus, comprising a photosensitive member, means for forming a latent image, means for developing the formed latent image, means for transferring a developed image to a transfer medium, and a cleaning blade, wherein said cleaning blade comprises a urethane elastomeric material incorporated with a porous nylon powder in such a manner that particles of the powder are embedded into the urethane elastomeric material to provide a substantially non-porous contact surface portion.

7. A facsimile system, comprising:

an electrophotographic apparatus provided with a photosensitive member, means for forming a latent image, means for developing the formed latent image, means for transferring a developed image to a transfer medium, and a cleaning blade comprising a urethane elastomeric material incorporated with a porous nylon powder in such a manner that particles of the powder are embedded into the urethane elastomeric material to provide a substantially non-porous contact surface portion; and means for receiving image information from a remote terminal.

* * * * *